US011518553B2

(12) United States Patent
Kleinheinz et al.

(10) Patent No.: US 11,518,553 B2
(45) Date of Patent: Dec. 6, 2022

(54) COMBINATION METERING ASSEMBLY FOR FILLING LIQUID PRODUCTS INTO CONTAINERS

(71) Applicant: Bausch + Ströbel Maschinenfabrik Ilshofen GmbH + Co. KG, Ilshofen (DE)

(72) Inventors: Fabian Kleinheinz, Groningen (DE); Harald Bauer, Rudelsdorf (DE)

(73) Assignee: BAUSCH + STRÖBEL MASCHINENFABRIK ILSHOFEN GMBH + CO. KG, Ilshofen (DE)

( * ) Notice: Subject to any disclaimer, the term of this patent is extended or adjusted under 35 U.S.C. 154(b) by 0 days.

(21) Appl. No.: 17/274,969

(22) PCT Filed: Aug. 28, 2019

(86) PCT No.: PCT/EP2019/072962
§ 371 (c)(1),
(2) Date: Mar. 10, 2021

(87) PCT Pub. No.: WO2020/052978
PCT Pub. Date: Mar. 19, 2020

(65) Prior Publication Data

US 2022/0033115 A1 Feb. 3, 2022

(30) Foreign Application Priority Data

Sep. 11, 2018 (DE) ..... 10 2018 215 444.9

(51) Int. Cl.
*B65B 3/26* (2006.01)
*B65B 3/00* (2006.01)
(Continued)

(52) U.S. Cl.
CPC ..... *B65B 3/26* (2013.01); *B65B 3/003* (2013.01); *B65B 37/06* (2013.01); *F04B 13/00* (2013.01);
(Continued)

(58) Field of Classification Search
CPC .. B65B 3/26; B65B 3/003; B65B 3/04; B65B 3/12; B65B 37/06; B65B 2210/08;
(Continued)

(56) References Cited

U.S. PATENT DOCUMENTS 3,363,571 A 1/1968 Reynolds et al.
5,911,252 A * 6/1999 Cassel ..... B65B 3/003 604/407

(Continued)

FOREIGN PATENT DOCUMENTS

DE 102017213810 A1 2/2019
WO 2020052978 A1 3/2020

OTHER PUBLICATIONS

German Application No. DE102018215444.9, "Search Report", dated May 23, 2019, 7 pages.

(Continued)

*Primary Examiner* — Nicolas A Arnett
(74) *Attorney, Agent, or Firm* — Kilpatrick Townsend & Stockton LLP

(57) ABSTRACT

The invention relates to a combination metering assembly for filling liquid products into containers. The invention is characterised by a base unit (1) and pump components (3, 4, 5, 6, 11, 12, 13, 14) of at least two different pump types for a metering operation, wherein the pump components of each pump type can be combined with the base unit in order to form a pump system of the corresponding pump type, and the base unit has connection means (19, 23) for this purpose which are compatible with the connections of the pump
(Continued)

components. The combination metering assembly can be adapted to different metering situations with little complexity and has a comparably small space requirement.

21 Claims, 5 Drawing Sheets

(51) Int. Cl.

| | |
|---|---|
| ***B65B 37/06*** | (2006.01) |
| ***F04B 13/00*** | (2006.01) |
| ***F04B 17/03*** | (2006.01) |
| ***F04B 23/10*** | (2006.01) |
| ***F04B 43/12*** | (2006.01) |

(52) U.S. Cl.
CPC ..... *F04B 17/03* (2013.01); *F04B 23/10* (2013.01); *F04B 43/12* (2013.01); *B65B 2210/08* (2013.01)

(58) Field of Classification Search
CPC ..... F04B 13/00; F04B 17/03; F04B 23/10; F04B 43/12
See application file for complete search history.

(56) References Cited

U.S. PATENT DOCUMENTS

| | | | | |
|---|---|---|---|---|
| 6,991,004 | B2 * | 1/2006 | Kaufhold | B01F 33/84 141/237 |
| 7,527,078 | B2 * | 5/2009 | Driessen | B01F 35/881 141/83 |
| 7,690,405 | B2 * | 4/2010 | Miller | B05B 1/28 222/383.2 |
| 7,905,711 | B2 | 3/2011 | Mochizuki et al. | |
| 8,561,656 | B2 | 10/2013 | Eginton et al. | |
| 10,464,098 | B2 * | 11/2019 | Saine | B05C 5/0208 |
| 2007/0012378 | A1 | 1/2007 | Miller et al. | |
| 2009/0084816 | A1 * | 4/2009 | Varga | F04C 11/003 222/138 |
| 2011/0139814 | A1 * | 6/2011 | Mueller | B65B 3/12 222/255 |
| 2011/0214423 | A1 * | 9/2011 | Givens | F02B 63/04 290/1 A |

OTHER PUBLICATIONS

International Application No. PCT/EP2019/072962, "International Preliminary Report on Patentability", dated Nov. 9, 2020, 26 pages.
International Application No. PCT/EP2019/072962, "International Search Report and Written Opinion", dated Dec. 5, 2019, 16 pages.

* cited by examiner

COMBINATION METERING ASSEMBLY FOR FILLING LIQUID PRODUCTS INTO CONTAINERS

CROSS REFERENCE TO RELATED APPLICATION

This application is a U.S. national phase of International Patent Application No. PCT/EP2019/072962 filed on Aug. 28, 2019, which claims priority to German Patent Application No. 10 2018 215 444.9, filed in Germany on Sep. 11, 2018. The entire contents of both applications are hereby incorporated herein by this reference.

DESCRIPTION

The invention relates to a combination metering assembly and a combination metering system for filling liquid products into containers, in particular for filling pharmaceutical liquids into syringe barrels, medicine bottles and the like.

Rotary lobe pumps, peristaltic pumps and time/pressure metering units are currently mainly used in order to fill, for example, syringe barrels with pharmaceutical liquids. These offer different advantages and disadvantages for different applications and filling situations. Consequently, there may be a need to replace a currently used pump with another pump in an existing filling system or even to provide a plurality of pump types directly in a filling system.

There can also be a situation in which the currently used pump has to be replaced by a pump of the same pump type that has been cleaned or sterilised and/or has a different pump capacity. This means that sometimes time-consuming and costly replacement procedures have to be carried out.

Metering systems made up of a plurality of complete pump systems provided in parallel have also been used. This results in a relatively large space requirement and has the disadvantage that the pumps cannot all be placed close to the filling point, which is why longer hose lengths are disadvantageously required, thus, not insignificantly, impairing the filling precision.

The object of the present invention is to overcome the aforementioned disadvantages and to provide a combination metering assembly which can be adapted to different filling situations or metering situations with little complexity.

To achieve this object, a combination metering assembly for filling liquid products into containers is proposed which is characterised by a base unit and pump components of at least two different pump types, the pump components of each pump type being combinable with the base unit in order to form a pump system of the corresponding pump type, and the base unit having connection means for this purpose which are compatible with the connections of the pump components.

The base unit is expediently designed in such a way that it has a frame or an integral mounting arrangement with connection options for the specified connection of the pump components, wherein pump components of a selected pump type connected thereto in combination with the base unit form a preferably directly operable pump system of this pump type. A drive shaft arrangement for operable coupling to corresponding pump components is preferably already provided on the base unit.

If a pump system of a different pump type is to be provided, this can be done in a simple manner by combining pump components of the different pump type with the base unit as specified in order to form a pump system of the different pump type.

Rotary lobe pumps and/or peristaltic pumps are preferably used as pump types.

The combination metering assembly has a modular structure, so that it can be equipped for various scopes and allows simple and uncomplicated replacement of components. It can be configured or put together according to the requirements of the respective metering systems.

The pump components include pump drive components and fluid delivery components to be driven thereby for the pumping operation. The pump drive components include transmission units and in some cases drive motors, in particular controllable electric motors. The fluid delivery components include pump heads with fluid displacement elements such as pump pistons, hose squeezing elements, etc.

According to a preferred embodiment of the invention, the base unit has a connection region for the connection of pump drive components and a connection region separated therefrom by a partition wall for the connection of fluid delivery components. In this way, fluid delivery components connected to the base unit can be effectively thermally insulated from the pump drive components also connected to the base unit, so that during operation of the combination metering assembly, the liquid filling material conducted in the region of the fluid delivery components is protected from heat coming from the region of the pump drive components.

The base unit preferably has a drive shaft arrangement extending through the partition wall and having a drive shaft for connecting at least one drive component to at least one fluid delivery component of a corresponding pump type.

In particular, a drive motor, preferably an electric motor, is provided as the drive component for connection to the drive shaft.

In particular, a pump head of a corresponding pump type is provided as the fluid delivery component for connection to the drive shaft.

According to one embodiment of the invention, such a pump head of a pump type has a power take-off to be coupled to the drive shaft and a power take-off connection for connecting pump components, in particular those of a further pump type, so that pump components connected to the power take-off connection via the power take-off can be driven by means of the drive shaft.

In this way, drive energy can be derived from the pump head, for example for a pump system of the further pump type.

The combination metering assembly preferably comprises components of a time/pressure metering device which can be operatively combined with the base unit and corresponding pump components in order to allow time/pressure metering operation of the combination metering assembly. Thereby, a CIP/SIP (=clean in place/sterilise in place) operation of a corresponding rotary lobe pump is also possible.

Preferably, pump components of one pump type and pump components of at least one further pump type can be combined with the base unit at the same time in order to configure at least two operational pump systems. For this purpose, a controllable switching device can be provided by means of which each of the pump systems can be selected for operation according to its configuration.

Such pump systems can also be operated in parallel.

With a combination metering assembly equipped in this way, it is possible to operate a plurality of pump systems, such as a rotary lobe pump, a peristaltic pump and time/pressure metering means, on a common, in particular space-saving structure with relatively short line lengths for the liquids to be metered. The combination metering assembly can also be designed in such a way that it is easier to access its components from the same position.

To reduce the number of servo shafts, they can be designed in such a way that they can be used by a plurality of pumps or metering systems of the combination metering assembly.

A plurality of adjacently arranged combination metering assemblies according to the present invention can, for example, be provided on a common frame and combined to form a common combination metering system, in particular for bulk metering operation for the metered filling of containers, for example in the pharmaceutical industry.

For this purpose, the metering system can have at least one drive source which is designed to provide drive energy for a plurality of the metering assemblies.

The combination metering assembly according to the invention is preferably programmably controllable by means of an electronic control device.

Preferred embodiments of the invention are explained in more detail below with reference to the drawings.

FIG. 1 shows a group of components of the combination metering assembly in the form of an exploded perspective view.

FIG. 2*a* shows a combination metering assembly assembled from components shown in FIG. 1 in a perspective view.

FIG. 2*b* shows the combination metering assembly from FIG. 2*a* in a longitudinal sectional view.

FIG. 2*c* shows the combination metering assembly from FIG. 2*a* in a view from below with the sectional plane of FIG. 2*b* indicated therein with B-B.

Figure 1:
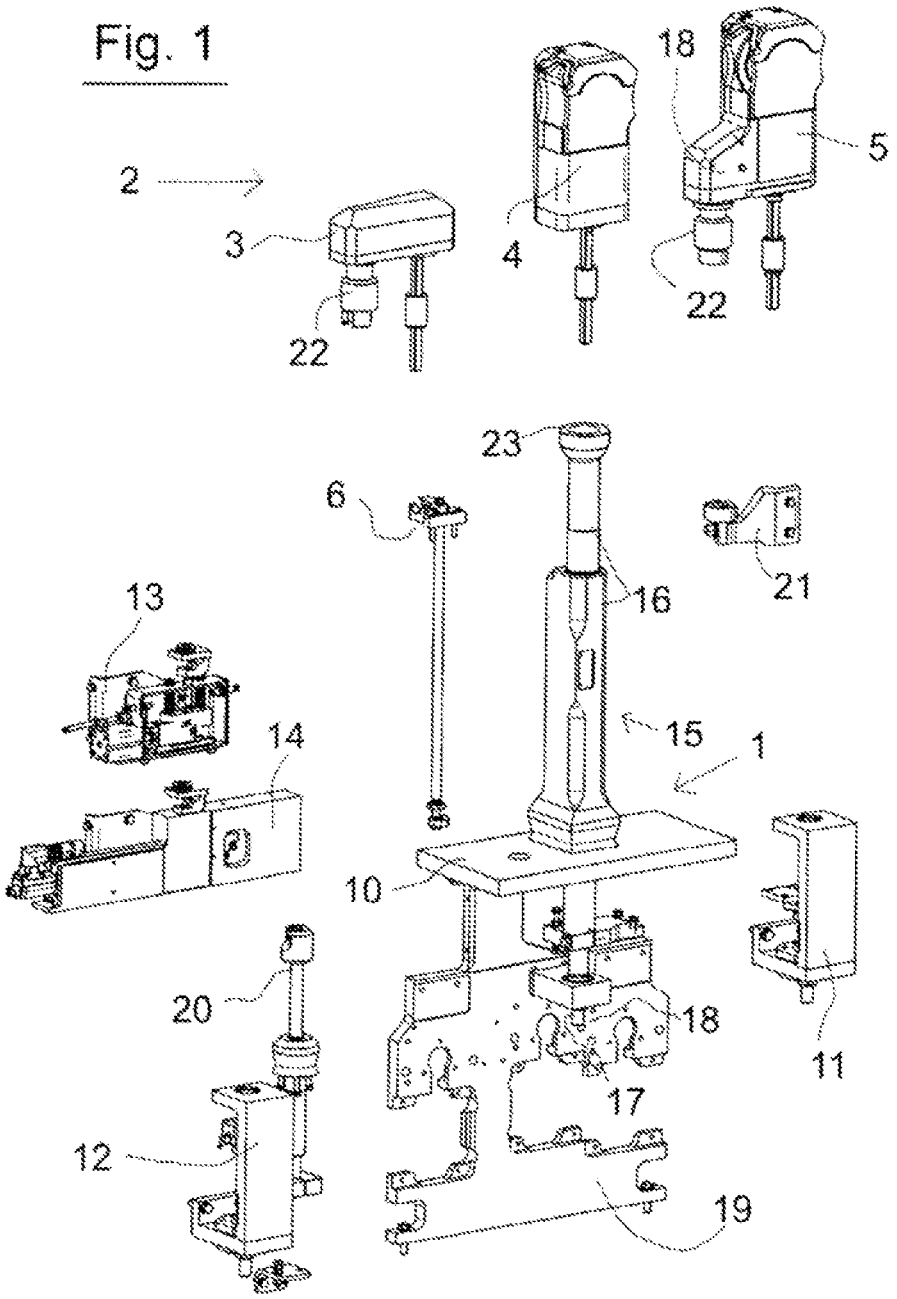

In FIG. 1, the basic unit of the combination metering assembly is identified by the reference sign 1.

Figure 3:
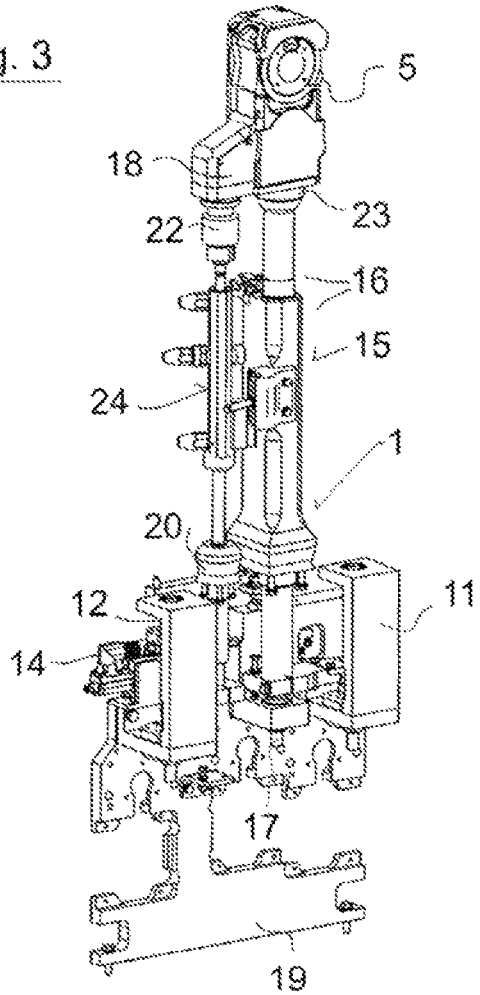
FIG. 3 shows a perspective view of an expansion stage of the combination metering assembly from FIG. 2*a* with a completed rotary lobe pump system.
Figure 4:
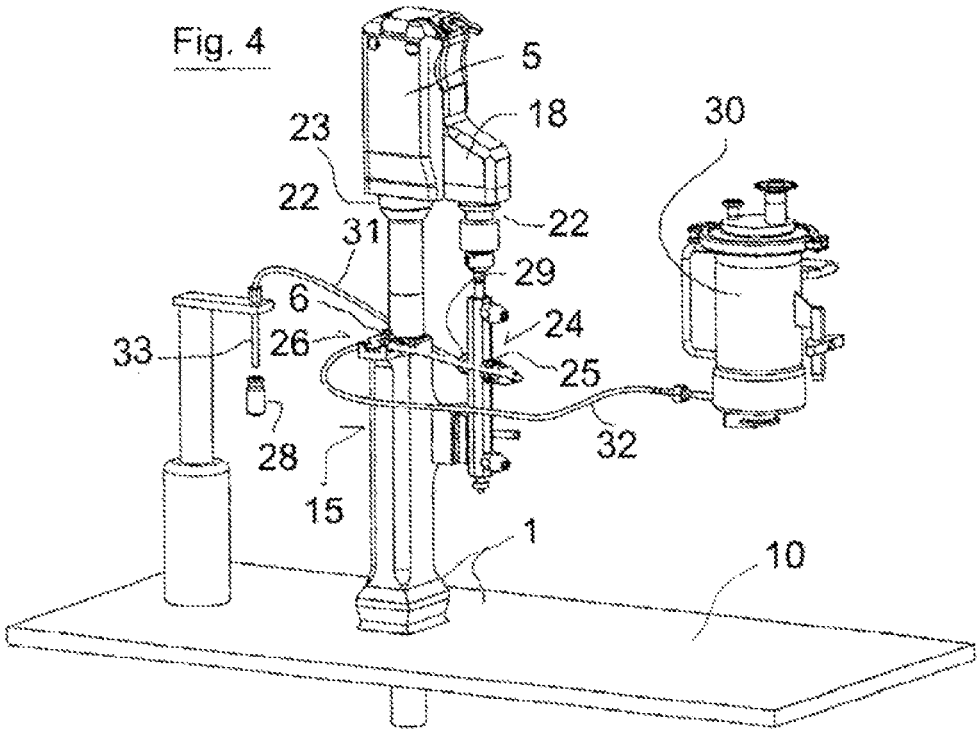
FIG. 4 shows a perspective view of an expansion stage of the combination metering assembly from FIG. 2*a* and FIG. 3 with a time/pressure metering device and a storage metering container.

A group of three exchangeable fluid delivery components, namely pump heads, is identified by reference sign 2, these pump heads being a rotary lobe pump head 3, a peristaltic pump head 4 and a peristaltic pump head 5 equipped with a power take-off having connection means for a rotary lobe pump (24 in FIG. 3 and FIG. 4).

Reference sign 6 indicates a hose-squeezing component of a time/pressure metering device in FIG. 1.

The base body 1 has a partition wall 10 which divides it into an upper region for the connection of fluid delivery components 3, 4 or 5 and a lower region for the connection of pump drive components 11, 12, 13 and 14.

In FIG. 1, reference sign 11 denotes a transmission which converts a motor rotation into a linear movement and by means of which, if necessary, stroke movements of a pump head connected as specified to the base body 1 can be generated. A controllable electric motor (not shown) is in particular suitable as the drive motor.

In FIG. 1, reference sign 12 denotes a transmission which converts a motor rotation into a linear movement and by means of which, if necessary, stroke movements of a pump foot 20 optionally connected to the base body 1 can be generated. In this case too, a controllable electric motor (not shown) is particularly suitable as the drive motor.

Alternative drive means for the hose-squeezing component 6 of the time/pressure metering device are identified by reference signs 13 and 14, namely a pneumatic drive device 13 and a linear motor drive device 14.

Mounting components or connection means for receiving a rotary lobe pump are identified by reference signs 20, 21 and 22.

The partition wall 10 is penetrated by a drive shaft arrangement 15. This has a drive shaft housing 16 and a drive shaft 17 rotatably mounted therein about its shaft axis. The drive shaft 17 is to be connected at its lower end 18 to a controllable drive motor, preferably an electric motor (not shown).

For the specified arrangement of the pump drive components 11, 12, 13, 14 and the drive motor for the drive shaft 17 and other motors on the base unit 1, the base unit 1 has a mounting plate 19 with connection contours for the pump drive components in its lower connection region.

At its upper end in FIG. 1, the drive shaft housing 16 has connection means 23 for the operational connection of a relevant pump head 3, 4 or 5 thereto, so that the corresponding pump head 3, 4 or 5 is coupled to the drive shaft 17 when connected accordingly.

Storage containers and containers to be filled as well as hose lines for the supply and discharge of the liquid to be metered are not shown in FIG. 1-3.

Figure 2C:
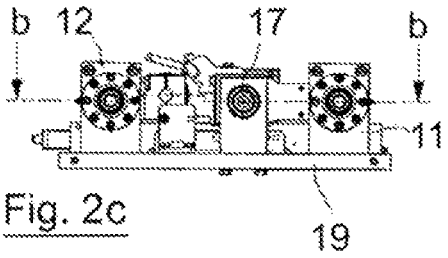
Figure 2B:
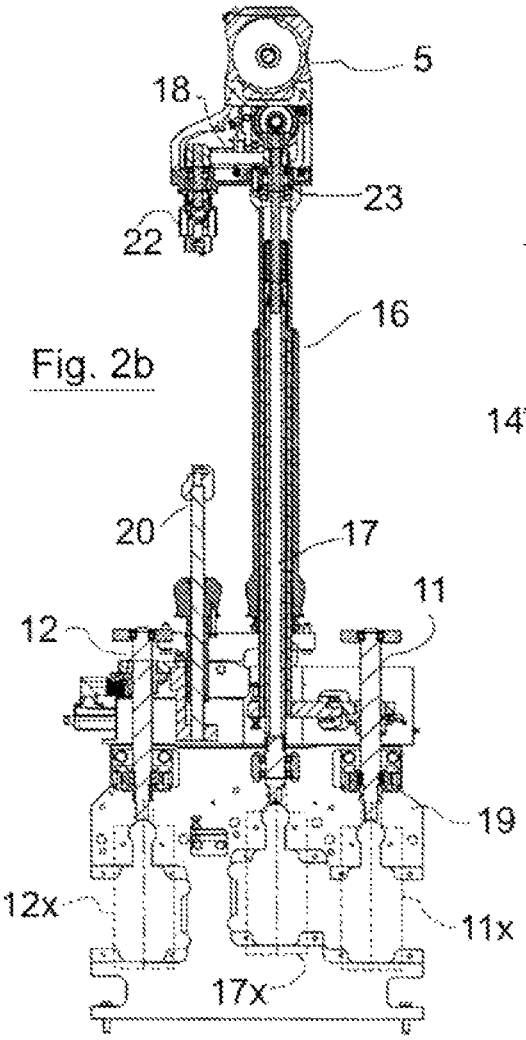
Figure 2A:
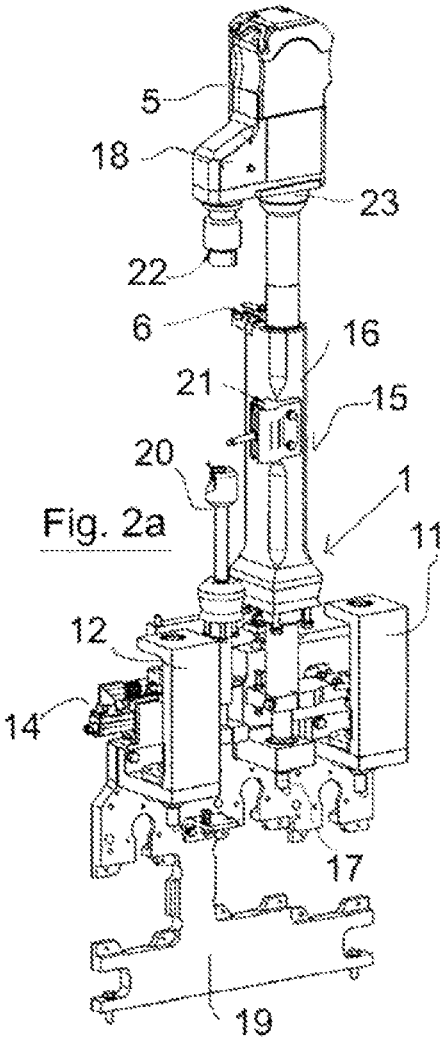

In the case of the combination metering assembly according to the invention, which is composed of components according to FIG. 1, the peristaltic pump head 5 equipped with a power take-off 18 with connection means 22 for a rotary lobe pump is combined with the base unit 1 via the connection means 23 of the drive shaft housing 16 and operatively coupled to the drive shaft 17, as shown in FIG. 2*a*. In this configuration, the arrangement forms a single-hose peristaltic pump system.

The partition wall 10 and the motors to be connected to the pump drive components 11, 12, 17 are not shown in FIG. 2*a*-2*c*, but their positions are indicated by dashed lines in FIG. 2*b* as x11, x12 and x17, respectively. Reference sign 11*x* denotes the installation position of the motor to be connected to the transmission 11, reference sign 12*x* denotes the installation position of the motor to be connected to the transmission 12 and reference sign 17*x* the installation position of the motor for the drive shaft 17.

FIG. 3 is a perspective view of an expansion stage of the combination metering assembly from FIG. 2*a*, wherein a completed rotary lobe pump system 24 having a rotary lobe pump connected at the connection 22 of the pump head 5 is also added in FIG. 3 in order to create a CIP/SIP (=clean in place/sterilise in place) version.

FIG. 4 shows a perspective view of another combination metering assembly according to the invention composed of corresponding components, wherein in FIG. 4, a completed rotary lobe pump system 24 and a time/pressure metering device 26 cooperating therewith, which serves as a shut-off device for the suction hose 32 in CIP/SIP mode, are added in addition to the equipment shown in FIG. 2*a* and FIG. 2*b*. The pump drive components provided below the partition wall 10 are not shown in FIG. 4, although they are present.

The combination metering assembly according to FIG. 4 is designed for metered filling of respective containers 28 with liquid. A supply of the liquid is located in a storage metering container 30. Not shown are the mounting and exchange means by means of which the containers 28 are brought into their filling position, held therein during the filing process and removed therefrom again.

The metering container 30 is connected to the combination metering assembly via a suction line 32. The suction line 32 is routed through the hose squeezer 6 of the time/pressure metering device 26 to the input connection of the rotary lobe pump system 24.

A filling line 31 is connected to the pressure-side connection 29 of the rotary lobe pump system 24 and has a filling needle 33 at its outlet end from which the liquid is introduced into the relevant container 28. The drives of the rotary lobe pump system 24 and the time/pressure metering device 26 are electronically controllable with a control device (not shown) of the combination metering assembly in order to allow the desired metering operation to run correctly.

Figure 5:
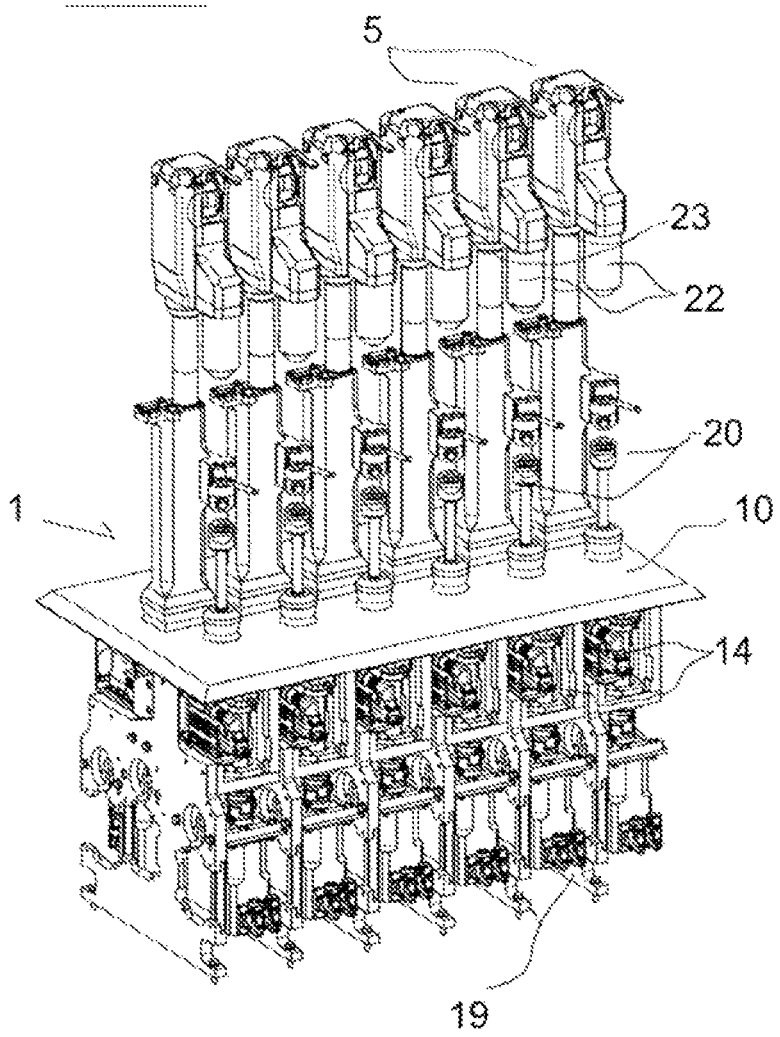
FIG. 5 shows a perspective view of a 6-position combination metering system according to the invention for in particular simultaneous filling of six containers.

FIG. 5 shows a perspective view of a 6-position combination metering system according to the invention for in particular simultaneous filling of six containers. The combination metering system comprises, for example, six metering assemblies of the type explained above, these preferably being connected to one another by common frame parts, for example a common intermediate plate 10'.

The invention claimed is:

1. A combination metering assembly for filling liquid products into containers, comprising:

a base unit and pump components of at least two different pump types for a metering operation, wherein the pump components of each pump type are combinable with the base unit in order to form a pump system of a corresponding pump type, wherein the base unit comprises connection means for combining the pump components of each pump type with the base unit, the connection means being compatible with connections of the pump components, wherein pump components of a first pump type and pump components of at least one pump type other than the first pump type are combinable with the base unit at a same time to configure at least two operational pump systems; and a controllable switching device by means of which each of the pump systems to be configured are selectable for operation, wherein in at least one configuration the pump systems are operable in parallel.

2. The combination metering assembly of claim 1, wherein the pump types comprise at least one of a rotary lobe pump and a peristaltic pump.

3. The combination metering assembly of claim 1, wherein the pump components comprise pump drive components and fluid delivery components to be driven by the pump drive components for the pumping operation.

4. The combination metering assembly of claim 3, wherein the base unit further comprises a first connection region for connecting the pump drive components and a second connection region separated from the first connection region by a partition wall for connecting the fluid delivery components.

5. The combination metering assembly of claim 4, wherein the base unit comprises a drive shaft arrangement extending through the partition wall and a drive shaft for connecting drive components to fluid delivery components of a corresponding pump type.

6. The combination metering assembly of claim 5, wherein an electric drive motor is provided as a drive component for connection to the drive shaft.

7. The combination metering assembly of claim 6, wherein a pump head of a corresponding pump type for connection to the drive shaft is provided as a fluid delivery component.

8. The combination metering assembly of claim 7, wherein the pump head comprises a power take-off coupled to the drive shaft and a power take-off connection for connecting pump components of a further pump type to the power take-off, so that pump components connected to the power take-off connection are drivable by means of the drive shaft.

9. The combination metering assembly of claim 1, further comprising components of a time/pressure metering device.

10. The combination metering assembly of claim 1, wherein the at least one pump type other than the first pump type comprises a second pump type and a third pump type combinable with the base unit at the same time.

11. A metering system comprising:

a plurality of combination metering assemblies, each of the plurality of combination metering assemblies comprising:

a base unit, first pump components of a first pump type, and second pump components of a second pump type, wherein the base unit comprises first connection means for combining the first pump components with the base unit to form a first pump system of the first pump type and second connection means for combining the second pump components with the base unit to form a second pump system of the second pump type, and wherein the first pump components and the second pump components are combinable with the base unit at a same time such that the first pump system and the second pump system are both operational; and wherein the plurality of combination metering assemblies are arranged adjacent to one another and provided on a common frame, wherein in at least one configuration the first pump system and the second pump system are operable in parallel.

12. The metering system of claim 11, further comprising a central drive source for providing drive energy for the plurality of combination metering assemblies.

13. The metering system of claim 11, further comprising a controllable switching device by means of which each of the first pump system and the second pump system to be configured are selectable for operation.

14. The metering system of claim 11, wherein the first pump type comprises at a rotary lobe pump and the second pump type comprises a peristaltic pump.

15. The metering system of claim 11, wherein the first pump components comprise pump drive components and the second pump components comprise fluid delivery components to be driven by the pump drive components for the pumping operation.

16. The metering system of claim 15, wherein the base unit comprises a first connection region for connecting the pump drive components and a second connection region separated from the first connection region by a partition wall for connecting the fluid delivery components.

17. The metering system of claim 16, wherein the base unit comprises a drive shaft arrangement extending through the partition wall and a drive shaft for connecting drive components to fluid delivery components of a corresponding pump type.

18. The metering system of claim 17, wherein an electric drive motor is provided as a drive component for connection to the drive shaft.

19. The metering system of claim 18, wherein a pump head of a corresponding pump type for connection to the drive shaft is provided as a fluid delivery component.

20. The metering system of claim 19, wherein the pump head comprises a power take-off that is able to be coupled to the drive shaft and a power take-off connection for connecting pump components of a further pump type to the power take-off, so that pump components connected to the power take-off connection are drivable by means of the drive shaft.

21. A combination metering assembly for filling liquid products into containers, comprising:

a base unit and pump components of at least three different pump types for a metering operation, wherein the at least three different pump types comprise at least one rotary lobe pump, at least one peristaltic pump, and at least one time/pressure metering device, wherein the pump components of each pump type are combinable with the base unit in order to form a pump system of a corresponding pump type, wherein the base unit comprises connection means for combining the pump components of each pump type with the base unit, the connection means being compatible with connections of the pump components, wherein (A) pump components of a first pump type, (B) pump components of a second pump type different from the first pump type, and (C) pump components of a third pump type different from the first pump type and the second pump type are combinable with the base unit at a same time to configure at least three operational pump systems; and a controllable switching device by means of which each of the pump systems to be configured are selectable for operation, wherein in at least one configuration the pump systems are operable in parallel.

* * * * *